United States Patent [19]

De Boer

[11] 3,997,967

[45] Dec. 21, 1976

[54] DRY SHAVER WITH AN EXTENDIBLE TRIMMER

[75] Inventor: Jan De Boer, Drachten, Netherlands

[73] Assignee: U.S. Philips Corporation, New York, N.Y.

[22] Filed: Apr. 16, 1975

[21] Appl. No.: 568,612

[30] Foreign Application Priority Data

May 1, 1974 Netherlands ..... 7405802

[52] U.S. Cl. ..... 30/34.1; 49/386

[51] Int. Cl.[2] ..... B26B 19/10; E05F 1/10

[58] Field of Search ..... 30/34.1, 90, 162, 163; 16/72, 80; 49/386

[56] References Cited

UNITED STATES PATENTS

| | | | |
|---|---|---|---|
| 307,767 | 11/1884 | Heysinger | 30/163 X |
| 3,233,324 | 2/1966 | Heide | 30/34.1 X |
| 3,604,111 | 9/1971 | Antretter | 30/34.1 |
| 3,800,328 | 3/1974 | Harlan | 49/386 X |

*Primary Examiner*—Gary L. Smith
*Attorney, Agent, or Firm*—Frank R. Trifari

[57] ABSTRACT

An electric dry-shaving apparatus having a trimmer which is extendible through a rectangular opening in the housing of the apparatus, and which can be retracted, with the opening being closed by a hinged flap.

5 Claims, 7 Drawing Figures

DRY SHAVER WITH AN EXTENDIBLE TRIMMER

BACKGROUND OF THE INVENTION

The invention relates to a dry-shaving apparatus which includes, a housing, an electric drive motor in the housing, and a shaving head driven by said motor. Also there is a trimmer, which comprises a cutter set of a toothed stationary trimming cutter and a toothed trimming cutter which is reciprocatable by the motor, as well as a trimmer frame to which the cutter set is secured, which frame is extendible; relative to the housing. An actuating member is connected to and moves the trimmer frame, and there is a substantially rectangular opening in the housing of the dry-shaving apparatus through which the trimmer can be slid out and slid in.

This type of dry-shaving apparatus is generally known from U.S. Pat. No. 3,889,371 and also French Patent No. 1,180,175. When the trimmer is slid out, it automatically engages the drive motor, and when the trimmer is slid in, it is automatically disengaged.

The rectangular opening in the apparatus remains visible, even when the trimmer is retracted and consequently extraneous matter might penetrate the dry-shaving apparatus through the rectangular opening. Another drawback is that such an opening negatively influences the appearance of the dry-shaving apparatus, and generally much attention is paid to said appearance which is considered to be of great importance for the success of a dry-shaving apparatus. It is an object of the invention to provide a dry-shaving apparatus of the type mentioned in the preamble which mitigates said drawbacks.

SUMMARY OF THE INVENTION

The invention is characterized in that, in the retracted condition of the trimmer, the rectangular opening is closed by a flap which is hingeable about an axis which is parallel to the long sides of the opening, and furthermore that the flap is hingeable from the closed position into the open position under the influence of an actuation button for sliding out the trimmer.

One embodiment of the invention requires only few parts and ensures trouble-free operation, and is characterized in that resilient means are provided for loading the hingeable flap in the direction of closure in any position of the flap; when the trimmer is slid out, the flap and the trimmer cooperate with each other so as to open the flap.

A further embodiment is characterized in that the flap is provided with integral hinge pins at the ends of one of its long sides, and the housing is provided with open slots in which the hinge pins are both movable and pivotable about their axis, and each hinge pin is loaded by an associated pressure spring. The flap is provided with a bent edge which cooperates with the housing of the shaving apparatus at a location which is disposed beside said open slots, so that the pressure springs and the reaction which is exerted by the housing exert a torque on the flap in the direction of closure.

The invention will be further explained with reference to the drawings as follows.

BRIEF DESCRIPTION OF THE FIGURES

Corresponding components in different Figures are denoted by corresponding reference numerals.

DETAILED DESCRIPTION OF THE PREFERRED EMBODIMENT

Figure 1:
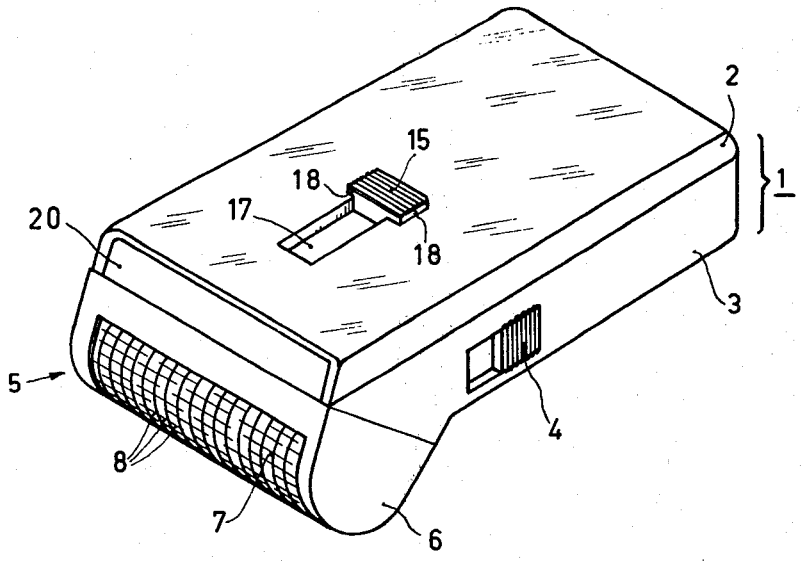
FIG. 1 shows a perspective view of a vibrator dry-shaving apparatus, which is provided with a thin flexible shear plate, and the trimmer retracted.
Figure 2:
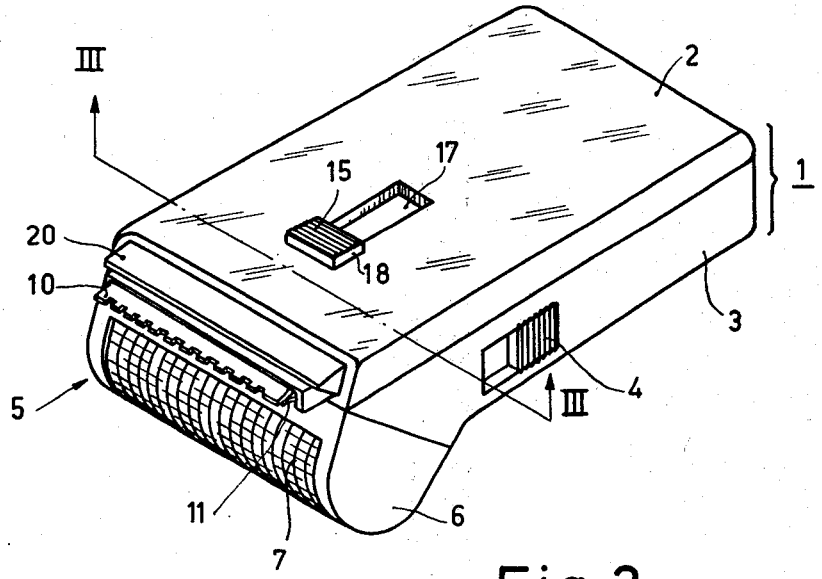
FIG. 2 shows the dry-shaving apparatus of FIG. 1 with trimmer extended.

The dry-shaving apparatus shown in FIG. 1 has a housing 1 which consists of two sections denoted by 2 and 3. Said housing accommodates an electric motor, not shown, which can be rendered operative and inoperative by a slide button 4. Disposed on the housing is a shaving head 5, which for example comprises the cap 6, and a thin flexible shear plate 7. Underneath the shear plate 7 the motor reciprocates a cutting block which is provided with a multitude of cutters. The shear plate 7 is provided with a multitude of hair entrance apertures 8 through which the hairs can come within range of the cutting edges of the cutting block in order to be shaved off.

Figure 3:
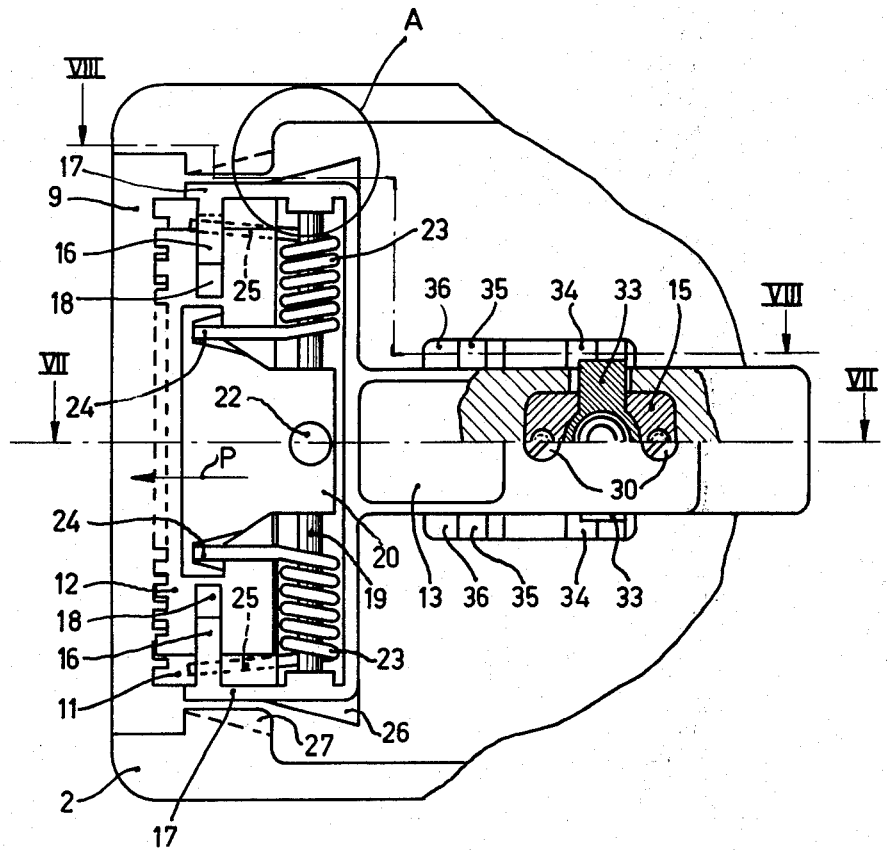
FIG. 3 shows a fragmentary sectional view taken along the line III—III in FIG. 2.
Figure 4:
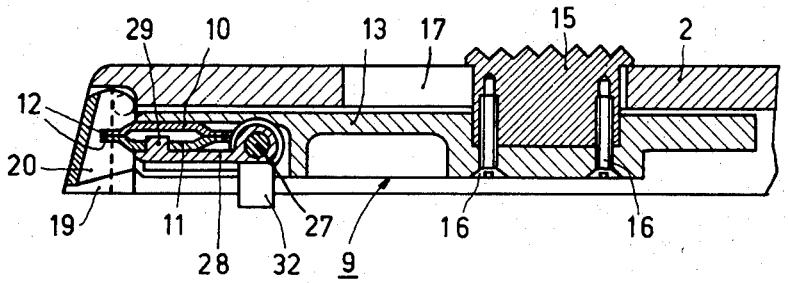
FIG. 4 is a fragmentary sectional view taken along the line IV—IV of FIG. 3.
Figure 5:
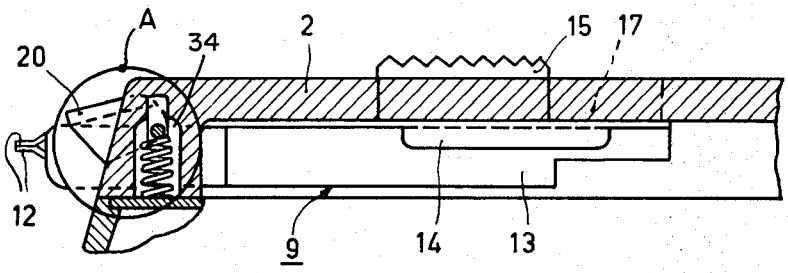
FIG. 5 is a fragmentary sectional view taken along the line V—V in FIG. 3, with the trimmer extended.

The dry-shaving apparatus shown has an extendible trimmer 9, particularly as shown in FIGS. 3, 4 and 5. This trimmer comprises a cutter set of a stationary trimming cutter 10 and a reciprocatable trimming cutter 11. Both cutters are provided with teeth 12. The trimmer 9 further comprises a trimmer frame 13 which is movably journalled in the housing section 2, on which frame the cutter set is mounted. The bearing for the trimmer frame 13 consists of two guide rims 14 which are integral with the housing section 2, and the slide button 15 which is attached to the frame 13 by means of two screws 16. The slide button 15 is slidable in a slotted opening 17 in the housing section 2, and at either side comprises projecting portions 18 which prevent the slide button 15 from being pulled into the housing through the slot 17. The housing has a rectangular opening 19, which only in FIG. 4 bears a reference numeral. Through said rectangular opening the trimmer 9 can be slid in and out by means of the slide button 15.

In the retracted condition of the trimmer the rectangular opening 19 is closed by the flap 20. Said flap comprises two integral hinge pins 21 at the end of its long sides. The housing section 2 is provided with open slots 22 in which the hinge pins 21 are both slidable and rotatable about their axis. The hinge pins are each loaded by an associated pressure spring 23. The flap 20 is provided with a bent edge 24 which cooperates with the housing section 2 of the shaving apparatus at a location which is situated beside the open slots 22, so that the pressure springs 23 and the reaction which is exerted by the housing section 2 exert a torque on the flap 20 in the closing direction thereof.

The trimmer frame 13, which is made of a plastic, comprises two cams or guides 25. The stationary trimming cutter 10 has openings which correspond to the guides 25 and is fixed relative to the frame 13 by said guides. The reciprocatable trimming cutter 11, however, has slotted openings 26 which are longer than the guides 25, so that these openings may serve for guiding the reciprocatable trimmer cutter. In the frame 13 a spindle 27 is mounted parallel to the rows of teeth 12 of the two trimming cutters 10 and 11. A pressure member 28 is reciprocatingly slidable on and is also rotatable about the spindle 27. Said member is provided with a drive element 29, see FIG. 4, which co-operates with a corresponding opening in the movable trimming cutter 11. Around the spindle 27 the two helically wound springs 30 are disposed, which, with their prolonged ends, 31 press on the pressure member 28, which in turn presses the two trimming cutters into engagement. The pressure member 28 can be reciprocated by the motor of the dry shaving apparatus by means of the pin 32.

Figure 6:
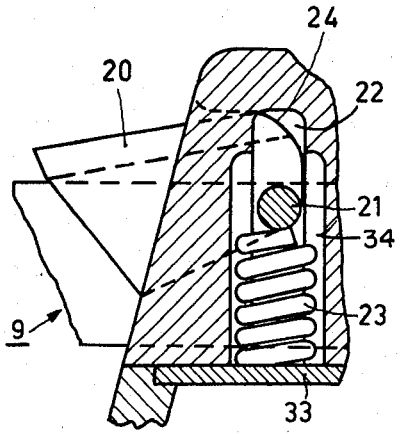
FIG. 6 is an enlarged view of detail A of FIG. 5.
Figure 7:
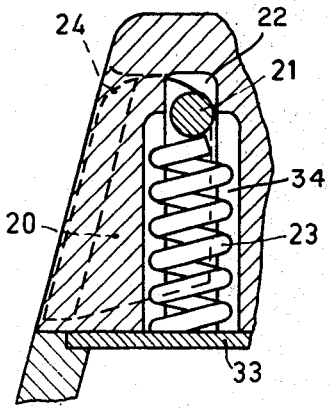
FIG. 7 is similar to FIG. 6, with the flap closed.

When a user of the dry-shaving apparatus wishes to use the built-in trimmer, for example for trimming the moustache or beard, the slide button 15 is manually moved towards the shaving head 5. As the trimmer 9 is moved forward, the trimming cutter 10 comes into contact with the flap 20. As the sliding movement continues the flap will be turned about the axis of the hinge pins 21 under the influence of the force which is exerted on it. Under the influence of the two pressure springs 23 the bent edge 24 then remains constantly in contact with the housing section 2. Owing to the location of the bent edge 24 relative to the two hinge pins 21, the hinge pins are shifted in the open slot 22. When the trimmer 9 has been slid out completely the flap 20 finally assumes the position shown in FIG. 6. When the trimmer is retracted again, the procedure is repeated, the flap 20 being closed by the torque which is exerted on the flap by the springs 23 and by the reaction which is exerted on the flap 20 by the housing 2 at the location of the bent edge 24.

For mounting the flap 20 and the two pressure springs 23, the hinge pins 21 are positioned in the open end of the open slot 22 and are slidingly moved therein. For the pressure springs 23, open round recesses 34 are formed in the housing section 3, in which the springs can be fitted manually. Finally, both the open slots 22 and the recesses 34 are closed with a closing plate 33.

The scope of the invention is not limited to the embodiment which is shown. The dry-shaving apparatus according to the invention may have an entirely different shape than the vibrator dry-shaving apparatus shown, and may for example consist of a dry-shaving apparatus with round shear plates provided with shaving slits and with cutting members which are rotated by a rotary motor and which cooperate with the shear plates. Furthermore, it is possible not to open the flap under the influence of the pressure exerted on it by the trimmer in the manner shown, but instead to connect separate members to the slide button 15 which serve for opening the flap. Such an embodiment may consist of the slide button 15, which as it is moved first opens the flap 20 by means of said separate members, which may comprise a lever transmission, and subsequently as the movement proceeds makes contact with the trimmer frame and moves said frame outwards. During subsequent retraction of the trimmer a reverse procedure takes place, the trimmer being moved in first, the trimmer and the slide button being disengaged next and the flap 20 being closed again by means of the lever system.

What is claimed is:

1. In a dry shaver including a housing having an aperture with top, bottom and end parts, a shaving head, a trimmer movable between a retracted position within the housing and an extended position extending partially through said aperture, and an actuating member movable between retracted and extend positions for moving said trimmer between its corresponding positions, the improvement in combination therewith, of means for selectively closing said aperture comprising a flap having top, bottom and end parts corresponding to those of the aperture, an axle at each of said flap ends defining a pivot axis, said housing further including a pair of spaced slots near the ends of said aperture and extending transversely of said pivot axis, each slot having top and bottom parts corresponding to those of said aperture, said axle end-parts situated in said slots, said improvement further comprising spring means in each of said slots urging the axle therein toward the top of said slot, and said flap being movable between closed position with said axles near the tops of the slots and said flap closing said aperture, and open position with said axles moved downward in said slots and said flap pivoted about said axis and thus opening at least a part of said aperture, said flap further comprising a curved cam surface which engages said aperture top part and causes said flap to move downward when said flap is pivoted toward its open position, said flap being pivoted toward its open position by said actuating member when said member is moved toward its extended position.

2. Apparatus according to claim 1 wherein said actuating member and said trimmer move linearly between said extended and retracted positions.

3. Apparatus according to claim 1 wherein said trimmer comprises a pair of stationary and reciprocating cutters.

4. Apparatus according to claim 1 wherein said improvement comprises a slidable frame within said housing, and said trimmer and actuating member are secured to said frame.

5. Apparatus according to claim 1 wherein said aperture defines a generally rectangular slot, and said flap comprises a generally rectangular plate having dimensions similar to those of said aperture.

* * * * *